United States Patent [19]

Eshleman

[11] Patent Number: 4,598,649

[45] Date of Patent: Jul. 8, 1986

[54] PARTICLE FUEL DIVERSION STRUCTURE WITH DOME-SHAPED CAVITY

[75] Inventor: Roger D. Eshleman, Waynesboro, Pa.

[73] Assignee: Eshland Enterprises, Inc., Greencastle, Pa.

[21] Appl. No.: 771,750

[22] Filed: Sep. 3, 1985

[51] Int. Cl.[4] ..... F23B 5/00; F23C 9/00; F23G 7/00

[52] U.S. Cl. ..... 110/211; 110/102; 110/118; 110/259

[58] Field of Search ..... 110/210, 211, 212, 214, 110/229, 248, 256, 259, 310, 311, 102, 118

[56] References Cited

U.S. PATENT DOCUMENTS

| | | | |
|---|---|---|---|
| 2,058,945 | 10/1936 | Barnett | 110/32 |
| 2,069,584 | 2/1937 | Lorton | 110/259 X |
| 3,259,083 | 7/1966 | Evans | 110/8 |
| 3,822,657 | 7/1974 | Midkiff | 110/101 CD |
| 3,861,332 | 1/1975 | Itasaka | 110/259 X |
| 3,865,053 | 2/1975 | Kolze et al. | 110/7 A |
| 3,932,137 | 1/1976 | Culpepper, Jr. | 23/277 C |
| 3,951,082 | 4/1976 | Leggett et al. | 110/8 A |
| 4,048,927 | 9/1977 | Augustin et al. | 110/210 X |
| 4,218,980 | 8/1980 | Probsteder | 110/196 |
| 4,274,341 | 6/1981 | Ozaltay | 110/229 |
| 4,309,965 | 1/1982 | Hill | 122/15 |
| 4,311,102 | 1/1982 | Kolze et al. | 110/103 |
| 4,312,278 | 1/1982 | Smith et al. | 110/234 |
| 4,377,115 | 3/1983 | Kolze et al. | 110/234 |
| 4,378,208 | 3/1983 | Payne et al. | 432/14 |
| 4,385,567 | 5/1983 | Yoss | 110/186 |
| 4,430,949 | 2/1984 | Ekenberg | 110/193 |
| 4,452,611 | 6/1984 | Richey | 48/111 |
| 4,479,481 | 10/1984 | Ingersoll et al. | 126/76 |

*Primary Examiner*—Edward G. Favors

*Attorney, Agent, or Firm*—Michael R. Swartz; John R. Flanagan

[57] ABSTRACT

A particle fuel burning furnace has an upper combustion chamber holding a pile of particle fuel and burning the same from the bottom. The furnace includes a lower combustion chamber for afterburning combustible gases off by burning solid fuel in the upper chamber and replaceable refractory bricks containing a series of spaced vertically-extending passageways interconnecting the bottom of the upper chamber and the top of the lower chambers for communicating combustible gases from the upper to the lower chamber. An improved particle fuel diversion structure in the furnace includes an elongated fuel diverter block having a recessed dome-shaped cavity therein and open at a bottom side and spacer blocks disposing the diverter block in the upper chamber in spaced relationship above the bottom of the upper chamber and with its recessed cavity overlying the bricks containing the passageways. Furthermore, the bricks extend above the bottom of the upper chamber and into the recessed cavity of the diverter block. The diverter block coacts with the upper chamber bottom and the passageway-containing bricks to define a flow path from the upper chamber to the lower chamber which passes along the bottom of the upper chamber under the diverter block, upwardly into the recessed cavity of the diverter block, and inwardly over the bricks and downwardly into the passageways. In such configuration, the flow path causes an increase in the dwell time of flow entrained particles in the upper chamber to promote combustion before they reach the lower chamber.

6 Claims, 3 Drawing Figures

PARTICLE FUEL DIVERSION STRUCTURE WITH DOME-SHAPED CAVITY

CROSS REFERENCE TO RELATED APPLICATION

Reference is hereby made to the following copending U.S. application dealing with subject matter related to the present invention: "Particle Fuel Diversion Structure" by Roger D. Eshleman, assigned U.S. Ser. No. 632,998 and filed July 20, 1984 U.S. Pat. No. 4,531,464.

BACKGROUND OF THE INVENTION

1. Field of the Invention

The present invention relates generally to particle fuel burning furnaces and, more particularly, is concerned with an improved fuel diversion structure defining a flow path from the upper chamber to the lower chamber which increases the dwell time of flow entrained particles in the upper chamber so as to promote combustion thereof before they reach the lower chamber.

2. Description of the Prior Art

In times of constantly increasing energy costs, the utilization of waste materials as fuel to produce energy is of increasing importance. Waste materials are amply available from various sources, for example, agricultural, forestry and industrial operations.

Many different furnaces (including incinerators and the like) appear in the prior art for burning conventional types of fuel, such as coal and wood, as well as waste or by-product types of particle fuel, such as sawdust, pulverized trash and wood chips. Representative of the prior art are the furnaces disclosed in Barnett (U.S. Pat. No. 2,058,945), Evans (U.S. Pat. No. 3,295,083), Midkiff (U.S. Pat. No. 3,822,657), Kolze et al (U.S. Pat. Nos. 3,865,053; 4,311,102; 4,377,115), Culpepper, Jr. (U.S. Pat. No. 3,932,137), Leggett et al (U.S. Pat. No. 3,951,082), Probsteder (U.S. Pat. No. 4,218,980), Hill (U.S. Pat. No. 4,309,965), Smith et al (U.S. Pat. No. 4,312,278), Payne et al (U.S. Pat. No. 4,378,208), Voss (U.S. Pat. No. 4,385,567), Ekenberg (U.S. Pat. No. 4,430,949) and Ingersoll et al (U.S. Pat. No. 4,479,481).

Another prior art furnace for burning waste product particle fuel is manufactured by Eshland Enterprises, Inc. of Greencastle, Pa. under the trademark "Wood Gun". Generally referred to as a wood gasification boiler, it has an insulated housing in which an upper, primary particle fuel retention and combustion chamber and a lower, secondary or afterburning combustion chamber are formed by refractory materials. A series of generally vertically extending passageways interconnect the bottom of the upper chamber with the top of the lower chamber. A quantity of waste particle fuel delivered into the upper chamber of the boiler through a fuel inlet in the top of the housing falls toward the bottom of the upper chamber and forms into a pile of fuel particles. The pile of particle fuel is ignited and burns from the bottom adjacent the location of the passageways. Periodically, the pile is replenished by delivery of additional particle fuel through the top fuel inlet of the housing. The portions of the refractory material containing the passageways are formed as separate removable bricks which can be replaced if they should deteriorate due to flame erosion over extended use without having to replace the whole of the refractory material.

Combustible gases generated as by-products from the burning of the particle fuel in the upper, primary chamber, along with air introduced into the upper portion of the primary chamber above the pile of fuel, are drawn downward through the passageways into the lower, secondary chamber by a draft inducing fan which creates a negative pressure drop in the lower chamber relative to the upper chamber. A suitable heat recovery unit is connected to the lower combustion chamber for capturing much of the heat produced by burning the combustible gases therein.

Notwithstanding the fact that the abovedescribed boiler has proven to be an efficient and economical way to convert waste products into usable heat energy, several problems have arisen which can adversely affect the long term operation of the furnace. First, some particles of fuel fall through the passageways into the lower combustion chamber during the normal course of operation with the result that air flow and combustion are impeded, thereby reducing the heat output of the furnace. Frequent cleaning is then required to remove the material deposited in the lower combustion chamber. Secondly, high temperature flames passing across the edges of the passageways cause spalding and erosion of the edge surfaces with the result that the passageways gradually become enlarged with continued use. When the wearing process has proceeded for some time, the passageways become so large that larger pieces of fuel will fall through the passageways, thus requiring premature replacement of the refractory bricks which incorporate the passageways.

To eliminate the occurrence of the abovementioned problems, a particle fuel diversion structure as illustrated and described in the above crossreferenced application was developed. When placed at the bottom of the upper chamber in spaced relationship above the passageways, the diversion structure creates a slot extending away from and upstream of the passageways which prevents most small size particles of fuel from falling through the passageways or from being drawn into the lower combustion chamber by the downdraft. Also, flame erosion now takes place on the edges of the diverter block of the diversion structure rather than in the passageways. The service life of the lower combustion chamber is greatly extended, and the relatively inexpensive fuel diverter block can be easily and conveniently replaced rather than the expensive refractory material. Also, the fuel diversion structure has the advantage of permitting the burning of finer particles, such as sawdust, shavings, and biomass pellets, than was possible heretofore.

While the fuel particle diversion structure has substantially reduced the earlier problems of refractory material flame erosion and fuel particle infiltration into the lower combustion chamber in most ordinary applications of the furnace, the burning of fuel particles of a very small size, such as pulverized wood waste fuel, has still proved to be impractical. The downdraft inducing fan which is employed to create a negative pressure in the primary combustion chamber also has the effect of aspirating the very small and light particles of fuel from the primary chamber and depositing them in the lower combustion chamber. Unless this effect is impeded in some manner, the lower chamber and ash recovery cyclone located downstream thereof rapidly fill with incompletely burned particles which necessitates very frequent cleaning. Consequently, a need still exists to make certain improvements which will facilitate combustion of very small fuel particles in the primary chamber of the furnace.

SUMMARY OF THE INVENTION

The present invention provides an improved particle fuel diversion structure designed to satisfy the aforementioned needs. The present invention retains the beneficial structural features of the prior diversion structure of the cross-referenced application and adds several improved features which overcome the problems left unsolved. These improved features are directed to the provision of an internal arcuate or dome-shaped cavity in the fuel diverter block and of an increase in the height of the replaceable bricks in the center row thereof which contain the vertical passageways. The pressure drop caused by air flow entering this cavity above the passageways produces a swirling effect which increases the dwell time sufficiently to consume the air entrained particles and prevent them from escaping into the lower combustion chamber and ash cyclone.

Accordingly, the present invention sets forth in a particle fuel burning furnace having an upper particle fuel holding and combustion chamber, a lower combustible gas afterburning chamber and means forming at least one passageway interconnecting a bottom of the upper chamber and a top of the lower chamber, an improved particle fuel diversion structure for facilitating the combustion of waste fuel, such as pulverized wood or fine sawdust, of very small size. The improved diversion structure comprises: (a) an elongated fuel diverter block having a recessed dome-shaped cavity formed therein and open at a bottom side thereof; and (b) means disposing the diverter block in the upper chamber in spaced relationship above the bottom of the upper chamber and with its cavity overlying the passageway. The diverter block coacts with the upper chamber bottom and the passageway-forming means to define a flow path from the upper chamber to the lower chamber which passes along the upper chamber bottom under the diverter block, upwardly into the resessed cavity of the diverter block, and then downwardly through the passageway. Thus, the dwell time of flow entrained particles in the upper chamber is increased and combustion thereof promoted before they reach the lower chamber. Further, the passageway-forming means extends above the upper chamber bottom and into the cavity such that the flow path must pass upwardly into the dome-shaped cavity and inwardly over the passagewayforming means before going downwardly through the passageway.

These and other advantages and attainments of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which.

DETAILED DESCRIPTION OF THE INVENTION

Figure 1:
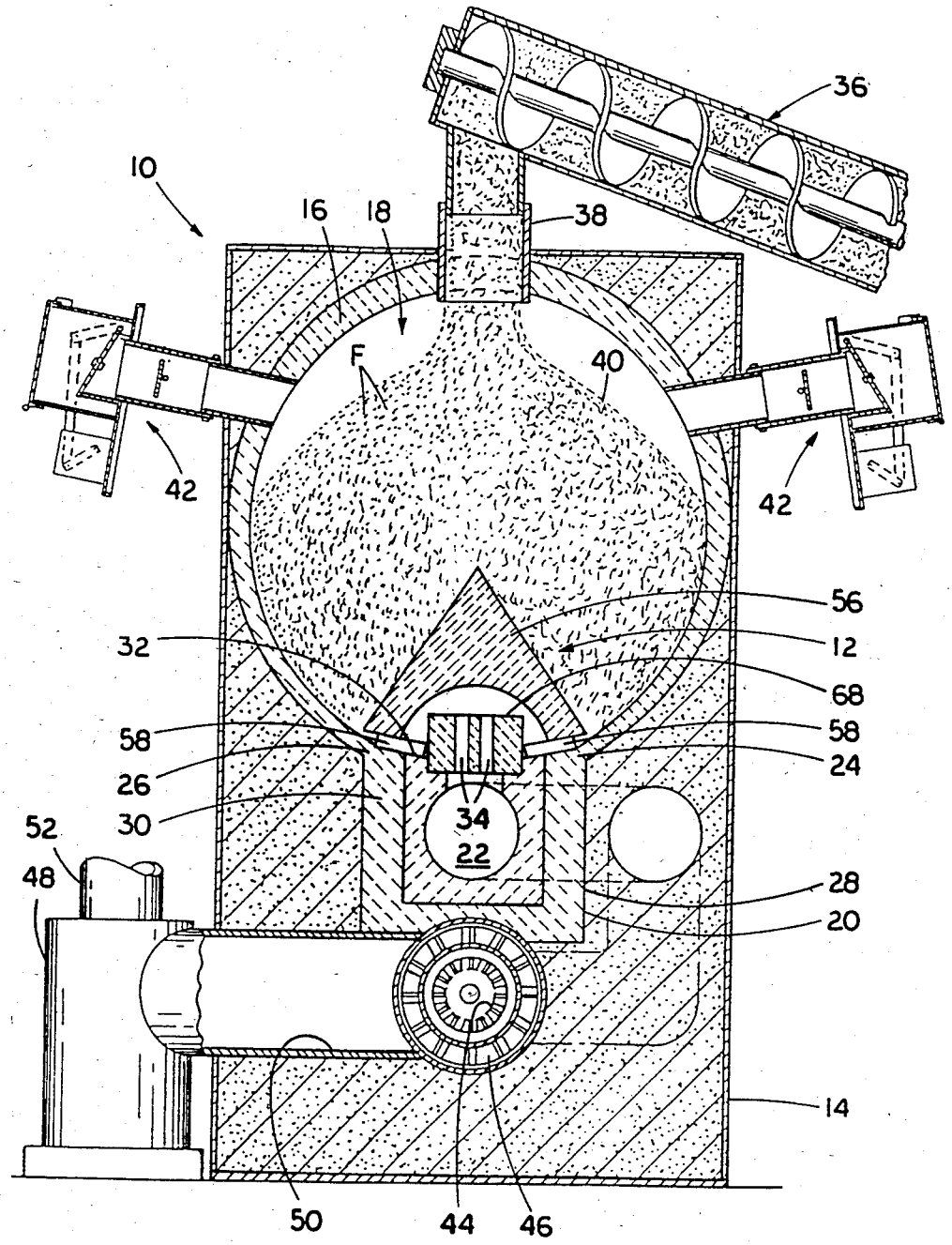
FIG. 1 is a sectional view of a particle fuel burning furnace incorporating the improved particle fuel diversion structure of the present invention.

In the following description, like reference characters designate like or corresponding parts throughout the several views of the drawings. Also in the following description, it is to be understood that such terms as "forward", "rearward", "left", "right", "upwardly", "downwardly", and the like are words of convenience and are not to be construed as limiting terms.

IN GENERAL

Referring now to the drawings, and particularly to FIG. 1, there is shown a furnace, being indicated generally by the numeral 10, for burning particle fuel F, for instance, composed of by-products of wood such as sawdust. The furnace 10 employs the improved particle fuel diversion structure, generally designated 12, which comprises the preferred embodiment of the present invention and will be described in detail later.

The particle fuel burning furnace 10 includes a generally rectangular insulated jacket or housing 14 containing a cylindrical shaped lining 16 formed of refractory material which defines an upper, primary particle fuel retention and combustion chamber 18 and a rectangular shaped lining 20 also formed of refractory material which defines a lower, secondary or afterburning combustion chamber 22. Both of the upper and lower combustion chamber 18,22 are generally cylindrical in shape and extend generally parallel to one another. Since the upper chamber 18 also serves as a holding or retention chamber for the solid particle fuel F, such as sawdust, being burned in the furnace 10, the upper chamber 18 is much larger in diameter than the lower chamber 22, although they both have substantially the same axial length.

The lining 20 defining the lower chamber 22 has a double wall construction, as seen in FIG. 1, which makes it much thicker than the lining 16 forming the upper chamber 18. The cylindrical upper chamber lining 16 is open along its bottom where its laterally spaced edges merge at 24,26 with respective spaced apart upper edges of an outer box-like wall portion 28 of the rectangular lining 20. An inner block-like wall portion 30 of the lining 20, which defines the lower chamber 22, nests within the outer wall portion 28 and at its upper surface 32 forms part of the bottom of the upper chamber 18.

Within the inner block-like wall portion 30 of the lining 20 and between left and right ends of the chambers 18,22 is formed a plurality of spaced apart, generally vertically-extending passageways 34 (only one pair of which is seen in FIG. 1) which interconnect the bottom of the upper chamber 18 with the top of the lower chamber 22. The passageways 34 together extend in a row in a direction generally parallel to the axial direction of each of the chambers 18,22 while each individual passageway 34 extends in a direction generally perpendicular to the axial direction of the chambers. The portions of the refractory material containing the passageways 34 are formed as separate removable bricks which can be replaced if they should deteriorate due to flame erosion over extended use without having to replace the whole of the refractory material.

Waste or by-product particle fuel, for instance sawdust, is delivered by any suitable means, such as an auger 36, into the upper chamber 18 of the furnace 10 through a fuel inlet 38 in the top of the housing 14 and the cylindrical lining 16. The particle fuel falls through the inlet 38 toward the bottom of the upper chamber 18 and forms into a pile 40 which covers the chamber bottom and the passageways 34. The fuel pile 40 grows in height within the upper chamber 18 until it reaches the general level seen in FIG. 1 at which a particle fuel delivery control device (not shown) is deactivated to terminate operation of the auger 36. As the pile 40 of particle fuel F burns and decreases in height, the particle fuel delivery control device is again activated to cause operation of the auger 36 for rebuilding the pile. Thereafter, periodically, the pile 40 is replenished by delivery of additional particle fuel through the top fuel inlet 38 of the housing 14. The particle fuel delivery control device comprises the invention described and illustrated in U.S. Pat. No. 4,513,671, which issued Apr. 30, 1985 to the inventor of the present invention.

Once ignited, the heat generated by a flame in the lower chamber 22 causes the pile 40 of particle fuel F to burn from the bottom adjacent to the location of the passageways 34. Combustible gases generated as by-products from the burning of the particle fuel in the upper chamber 18, along with air introduced into the upper portion of the upper chamber via a pair of air intake valve subassemblies, generally designated 42, are drawn downward through the passageways 34 into the lower chamber 22 by a draft inducing fan 44 which communicates with the lower chamber 22 via a swirl chamber 46. The air intake valve subassembly 42 comprises the invention described and claimed in application Ser. No. 715,847, filed Mar. 25, 1985 also by the inventor of the present invention.

Suitable heat transfer or recovery means, such as coil tubing or a pressure vessel (not shown), is located in either or both of the refractory linings 16,20 for capturing much of the heat produced by burning particle fuel in the upper chamber 18 and combustible gases in the lower chamber 22. Also, most of the fly ash is removed from the remaining products of combustion in the lower chamber 22 by a cyclone ash collector 48 connected in communication with the lower chamber 22 via a branch tunnel 50 connected to the swirl chamber 46. As the fly ash is collected in the collector 48, the exhaust gases pass to the atmosphere through a exhaust conduit 52.

IMPROVED PARTICLE FUEL DIVERSION STRUCTURE

Figure 2:
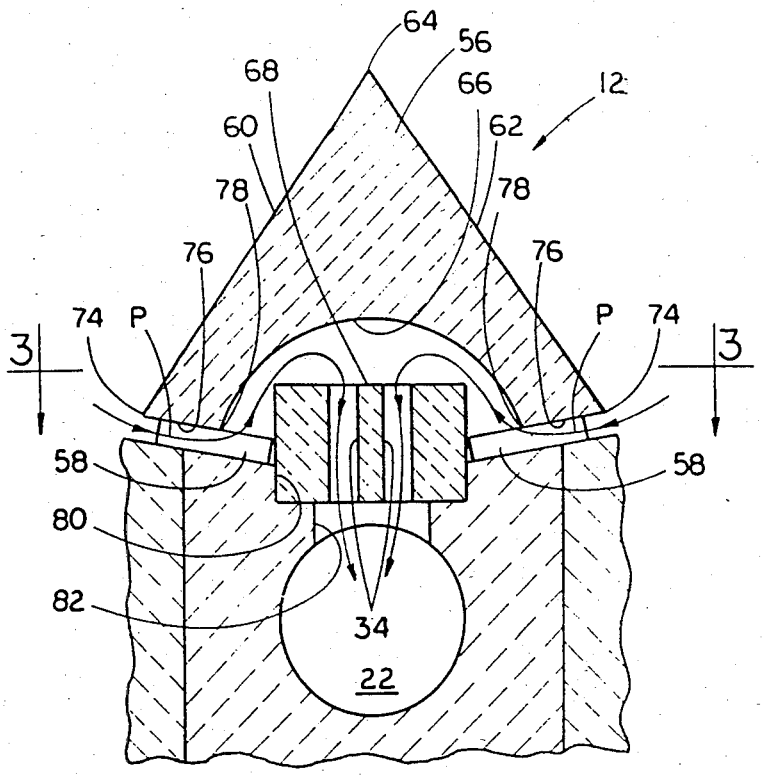
FIG. 2 is an enlarged view of a fragmentary portion of the furnace of FIG. 1, which includes and more clearly illustrates the improved diversion structure of the present invention.
Figure 3:
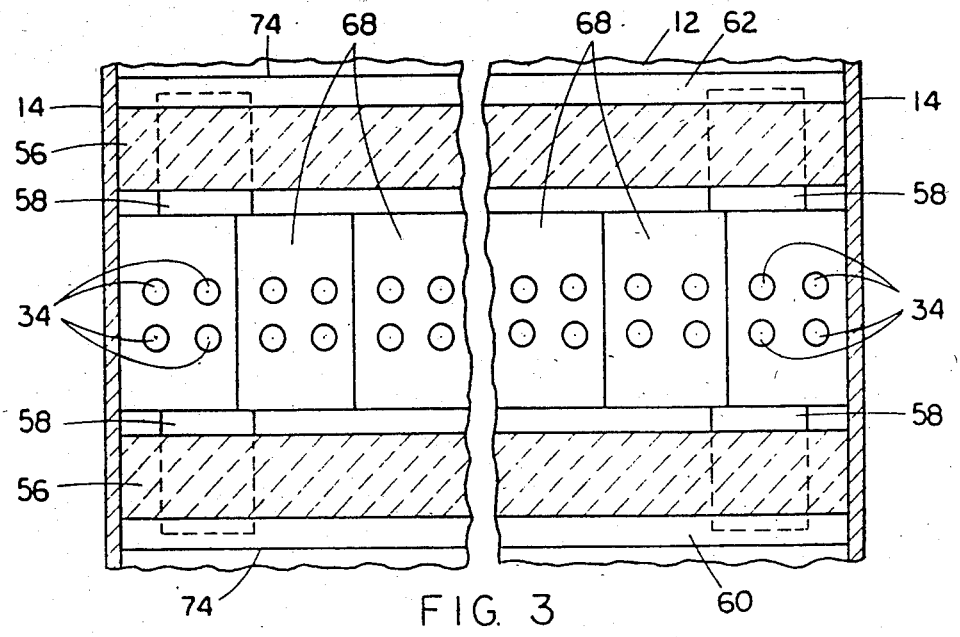
FIG. 3 is a sectional view taken along line 3—3 of FIG. 2 and then rotated counterclockwise ninety degrees.

As in the case of the prior particle fuel diversion structure described and illustrated in the application cross-referenced above, the improved diversion structure 12 of the present invention, as seen in FIGS. 2 and 3 in addition to FIG. 1, is incorporated into the furnace 10 at the bottom of the upper chamber 18 adjacent to and overlying the passageways 34 leading from the upper chamber 18 to the lower chamber 22. Also, the improved diversion structure 12 creates a pair of slots 54 extending generally horizontally and laterally outwardly away from the passageways 34 to the upper chamber 18 which relocate the position of the flame at the bottom of the pile 40 and prevent particles of fuel from falling through the passageways 34. Additionally, like the prior diversion structure, the improved diversion structure 12 includes an elongated fuel diverter block 56 having a generally triangular cross-sectional shape and at least a pair of spacer blocks 58 located below either end of the diverter block 56 for elevating it above the upper surface 32 of the liner 20 (bottom of the upper chamber 18) which has the lower chamber 22 formed therein. Still further, the triangular configuration of the diverter block 56 provides a pair of exterior surfaces 60,62 which slope downwardly and oppositely outwardly away from an upper central edge 64 of the block 56 displaced above the passageways 34. The oppositely sloping surfaces 60,62 direct the flow of particles of fuel F away from passageways 34 so as to prevent small particles from falling through the passageways and to make it more difficult for them to be drawn into the lower chamber 22 by a downdraft.

However, the improved diversion structure 12 of the present invention includes several design features not found in the prior diversion structure which offer additional safeguards against small size particles being aspirated into the lower chamber 22 by a downdraft. These features basically relate to the formation of a recessed, concave or dome-shaped cavity 66 in the fuel diverter block 56 and an increase in the height of the center bricks 68 which contain the vertical passageways 34 from upper chamber 18 to the lower chamber 22.

The diverter block 56 of the improved diversion structure 12 has a solid construction except for the recessed dome-shaped cavity 66 formed therein which opens at a bottom side of the block. Also, the upper central edge 64 of the block 56 is displaced above its recessed cavity 66 and the pair of surfaces 60,62 slope downwardly and oppositely outward from the upper edge 64 in spaced relation to the cavity 66, terminating at respective lower lateral opposite edges 74. Further, a pair of slightly inclined bottom surfaces 76 interconnect the lateral outward sloping surfaces 60,62 at lower edges 74 with the opposite bottom edges 78 of the recessed cavity 66.

The spacer blocks 58 extend under and support the diverter block 56 at its bottom surfaces 76 so as to dispose it in the upper chamber 18 in a spaced relationship above the upper chamber bottom 32 and with its recessed cavity 66 aligned in overlying relation to the passageways 34 contained in the row of central bricks 68. Also, the central bricks 68 are supported in a recess 80 formed in the upper surface 32 of the lining 20 and across a passageway extension 82 which communicates with the passageways 34 through the bricks 68 and opens into the lower chamber 22. From the lining recess 80, the bricks 68 extend above the upper surface 32 (or bottom of the upper chamber 18) and into said recessed cavity 66 of the diverter block 56.

As a result of the arrangement of the diverter block 56 spaced above the upper chamber bottom 32 and its cavity 66 spaced above and overlying the passageways 34 as described above, the diverter block 56 coacts with the upper chamber bottom 32 and the central passageway-containing bricks 68 to define a flow path P from the upper chamber 18 to the lower chamber 22. The flow path P passes from the upper chamber 18 along the bottom 32 thereof and under the bottom surfaces 76 of the diverter block 56 from both of the opposite lateral edges 74 thereof. Next, the flow path P turns upwardly from opposite sides of the central blocks 68 and proceeds into the recessed cavity 66 of the diverter block 56. Then, the path P goes inwardly over the central bricks 68 and turns downwardly into and through the passageways 34 of the bricks from where it proceeds through the passageway extension 82 into the lower chamber 22.

With such flow path configuration, a pressure drop results due to the air flow having to turn upwardly into the cavity 66. A swirling effect in the flow path P is then produced which causes an increase in the dwell time of flow entrained particles in the upper chamber 18 so as to promote combustion thereof before they reach the lower chamber 22. Thus, the small, light particles are consumed before they can escape into the lower chamber 22 and cyclone collector 48.

It is thought that the improved features of the particle fuel burning furnace of the present invention and many of its attendant advantages will be understood from the foregoing description and it will be apparent that various changes may be made in the form, construction and arrangement thereof without departing from the spirit and scope of the invention or sacrificing all of its material advantages, the form hereinbefore described being merely a preferred or exemplary embodiment thereof.

I claim:

1. In a particle fuel burning furnace having an upper particle fuel holding and combustion chamber, a lower combustible gas afterburning chamber and means forming at least one passageway interconnecting a bottom of said upper chamber and a top of said lower chamber, an improved particle fuel diversion structure comprising:

(a) an elongated fuel diverter block having a recessed cavity formed therein; and (b) means disposing said diverter block in said upper chamber in spaced relationship above said bottom of said upper chamber and with its recessed cavity overlying said passageway, said diverter block coacting with said upper chamber bottom and said passageway-forming means to define a flow path from said upper chamber to said lower chamber which passes along said bottom of said upper chamber under said diverter block, upwardly into said cavity of said diverter block, and then downwardly through said passageway so as to cause an increase in the dwell time of flow entrained particles in said upper chamber and thereby promote combustion of said particles before they reach said lower chamber.

2. The improved diversion structure as recited in claim 1, wherein said recessed cavity is concave in shape and opens at a lower side of said block.

3. The improved diversion structure as recited in claim 1, wherein said recessed cavity is dome-shaped.

4. The improved diversion structure as recited in claim 1, wherein said passageway-forming means extends above said upper chamber bottom and into said recessed cavity such that said flow path must pass upwardly into said cavity and inwardly over said passageway-forming means before proceeding downwardly through said passageway.

5. In a particle fuel burning furnace having an upper particle fuel holding and combustion chamber, a lower combusitble gas afterburning chamber and means forming a series of passageways arranged in a row and interconnecting a bottom of said upper chamber and a top of said lower chamber, an improved particle fuel diversion structure comprising:

(a) an elongated fuel diverter block having a solid construction and a recessed cavity formed therein which opens at a bottom side of said block;

(b) means disposing said diverter block in said upper chamber in spaced relationship above said bottom of said upper chamber and with its recessed cavity overlying said passageways; and (c) said passageway-forming means extending above said bottom of said upper chamber and into said recessed cavity of said diverter block;

(d) said diverter block coacting with said upper chamber bottom and said passageway-forming means to define a flow path from said upper chamber to said lower chamber which passes along said bottom of said upper chamber under said diverter block, upwardly into said recessed cavity of said diverter block, and then inwardly over said passageway-forming means and downwardly through said passageways therein, said flow path causing an increase in the dwell time of flow entrained particles in said upper chamber so as to promote combustion thereof before they reach said lower chamber.

6. The improved diversion structure as recited in claim 5, wherein said diverter block also has an upper central edge displaced above said recessed cavity of said block and a pair of surfaces which slope downwardly and oppositely outward from said upper edge to respective lower lateral opposite edges of said block.

* * * * *